United States Patent [19]

Baumer

[11] 4,388,867

[45] Jun. 21, 1983

[54] CIRCUIT ARRANGEMENT FOR A COMBINED PROXIMITY AND IMPACT FUSE

[75] Inventor: Hans Baumer, Senden, Fed. Rep. of Germany

[73] Assignee: Licentia Patent-Verwaltungs-GmbH, Frankfurt am Main, Fed. Rep. of Germany

[21] Appl. No.: 246,698

[22] Filed: Mar. 23, 1981

[30] Foreign Application Priority Data

Mar. 22, 1980 [DE] Fed. Rep. of Germany ..... 3011231

[51] Int. Cl.[3] ..... F42C 13/00

[52] U.S. Cl. ..... 102/211; 102/216

[58] Field of Search ..... 102/211, 212, 213, 214, 102/216, 265

[56] References Cited

U.S. PATENT DOCUMENTS

| | | | |
|---|---|---|---|
| 3,786,758 | 1/1974 | Zimmerman | 102/216 |
| 3,850,102 | 11/1974 | Morrow | 102/211 |
| 3,853,065 | 12/1974 | Apstein | 102/214 |
| 3,926,120 | 12/1975 | Williams et al. | 102/211 |
| 3,994,229 | 11/1976 | Flowers | 102/214 |
| 4,030,420 | 6/1977 | Skagerlund | 102/211 |
| 4,036,142 | 7/1977 | Williams | 102/201 |

*Primary Examiner*—Charles T. Jordan

*Attorney, Agent, or Firm*—Spencer & Kaye

[57] ABSTRACT

A combined proximity and impact fuse employed in a missile, including a circuit arrangement for avoiding the actuation of a detonation upon impingement of the impact fuse on a rain drop. The circuit arrangement is connected to the proximity fuse and is respective to the signals produced by the same to prevent the generation of a detonation signal upon impact until recognition by the proximity fuse that a given release criterion for impact detonation has been met.

8 Claims, 4 Drawing Figures

FIG. 3
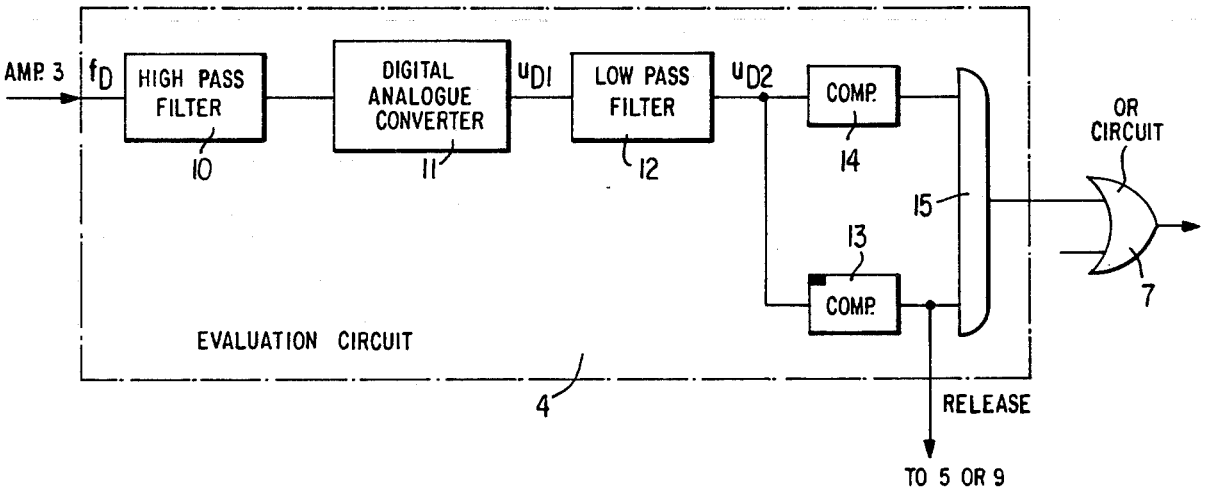
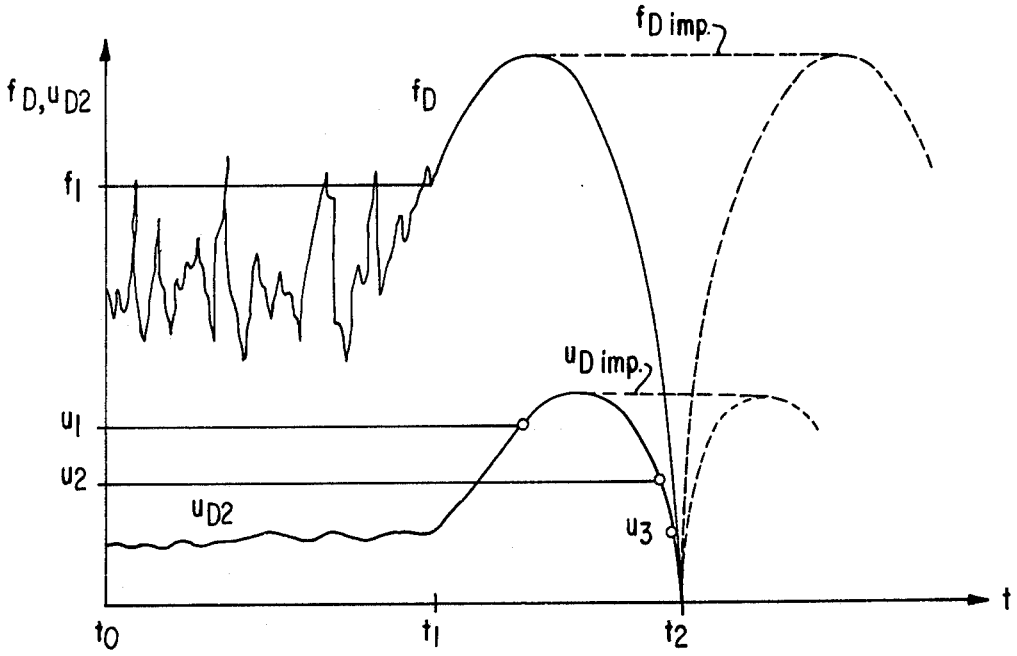
FIG. 4

CIRCUIT ARRANGEMENT FOR A COMBINED PROXIMITY AND IMPACT FUSE

BACKGROUND OF THE INVENTION

The present invention relates to a combined proximity and impact fuze and more particularly to a circuit arrangement for such a fuze for preventing the actuation of a detonation upon impingement on a rain drop.

Combined proximity and impact fuzes are used, in particular, to fight flying targets by means of barrel weapons or missiles, but can also be used against ground and water target objects. In principle, the type of sensor employed in the proximity fuze is of no significance. Such sensors may operate, for example, not only according to the radar principle but also according to all other electronic target detection methods known in the munitions art. For example, the proximity sensor may operate with the aid of a laser, according to an acoustical method or by evaluation of the changes in electrical or magnetic fields upon approach to the target. The impact fuze may likewise be of any desired type, for example, a piezoelectric fuze or a mechanical fuze.

For the impact fuze, in some applications, firing already must be effected with certainty when the fuze impacts on very thin metal sheets, possibly under a very flat impact angle. For that reason, in such cases, the fuze must be set to be so sensitive that impinging rain drops could inadvertently cause a detonation before the factual target has been reached. The same applies, of course, also for snow and hail.

Various rain drop safety devices for impact fuses are already known, but they all prevent the actuation of a detonation signal on the part of the sensor when it impinges on rain drops by mechanical means.

SUMMARY OF THE INVENTION

The present invention is based on the realization that in a combined proximity and impact fuze, this rain drop safety can be realized in a very effective and simple manner in that it is not necessary, in principle, to prevent the actuation of a detonation signal by the impact sensor upon impact with a rain drop. Rather, a circuit arrangement can be connected in series with the impact sensor which circuit arrangement is controlled by the function of the proximity fuze so as to prevent actuation of the detonation even when a detonation signal is emitted by the impact sensor, if the proximity sensor determines that the detonation criterion for impact detonation has not yet been met.

The present invention thus solves the problem of avoiding actuation of detonation of a combined proximity and impact fuze upon impact on a rain drop in a more rational manner, compared with the prior art, and with greater efficiency. More specifically, the present invention solves the above problem in that in a combined proximity and impact fuze employed in a missile, a circuit arrangement is provided for avoiding the actuation of a detonation upon impingement of the impact fuze on a rain drop with this circuit arrangement comprising means connected to the proximity fuze and responsive to the signals produced by the same for preventing the generation of a detonation signal upon impact until recognition by the proximity fuze that a given release criterion for impact detonation has been met.

Various release criteria can be used according to the invention. For example, detonation upon impact can be permitted only if the proximity fuze has already recognized a target. Thus, detonation signals originating from the impact sensor are transmitted to the detonator cap only if a true target object is in the vicinity of the detonator.

However, in some proximity fuzes which are able already to detect a target at a great distance, it is often more advisable to use as the release criterion for impact detonation the approach to a target up to a given target distance. This target distance may be determined, at least in a rough approximation, by the proximity fuze, either from the amplitude of its received signals or signals derived therefrom. Alternatively, it may be based on a known target distance measuring method, for example, by measuring the delay time according to the reflected pulse method or according to the principle of a radio altimeter.

If a proximity fuze moves almost directly toward a target object and continuously measures the relative radial velocity, the measured velocity value will remain constant, within given tolerances, during approach toward the target. This characteristic can be utilized as well, according to an embodiment of the invention, in that an evaluation circuit determines whether this measured velocity value remains constant over a given time interval after detection of the target. As an alternative of this embodiment of the invention, this checking whether the measured velocity value remains constant is performed within a given target distance range, for example, shortly before reaching the target.

In all the above cases, impact detonation is released only a few meters before the target is reached so that it can be assumed with high probability that no rain drop will impinge on the impact sensor from the time of the release until the time of impact to actuate an inadvertent impact detonation.

BRIEF DESCRIPTION OF THE DRAWINGS

FIG. 3 is a block circuit diagram of a preferred embodiment of an evaluation circuit 4 of the circuits according to FIGS. 1 and 2.

FIG. 4 is a explanatory diagram of the function of the circuit according to FIG. 3.

DETAILED DESCRIPTION OF THE PREFERRED EMBODIMENTS

Figure 1:
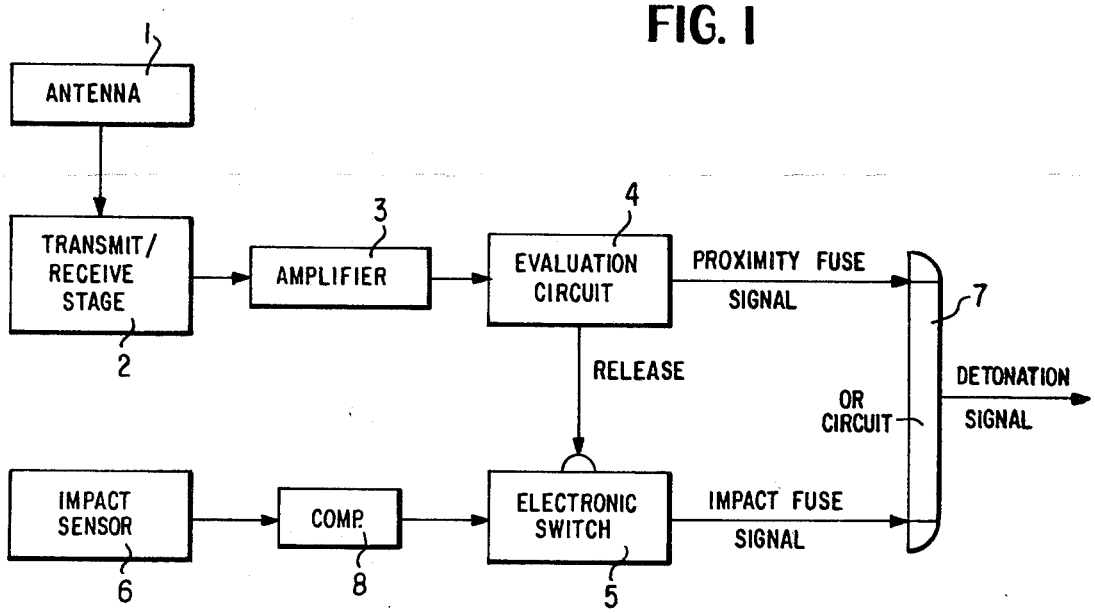
FIG. 1 is a block circuit diagram of one embodiment of a combined proximity and impact fuze according to the invention.

In the embodiment of the combined proximity and impact fuze shown in FIG. 1, the proximity fuze is a radar fuze which transmits and receives its signals via a combined transmitting-receiving antenna 1 for a transmitting-receiving stage 2 which delivers an output signal the frequency of which is the difference between the transmitted frequency and the received frequency. This difference frequency is commonly described as Doppler frequency $f_D$. The output of the transmitting-receiving stage 2 is connected to an amplifier 3 which is followed by an evaluation circuit 4. The evaluation circuit 4 evaluates the received and amplified proximity signals to provide a proximity fuze signal of its signal output which is connected to one input of an OR circuit 7. The evaluation circuit 4 also evaluates the received and amplified proximity signals to determine whether a predetermined or given release condition or criterion for impact detonation has been met and, if so, to change the output signal on its control output which is connected to the control input of an electronic switch 5 connected in the signal path of the impact fuze.

With the given release criterion for impact detonation being selected to be the detection of a target by the proximity fuze, if the evaluation circuit 4 detects a target, the output control or release signal delivered to the electronic switch 5 causes the switch 5 to switch each output signal from the impact sensor 6 to the other input of the OR linkage circuit 7, at whose output will appear the actual detonation signal for the detonator cap. Preferably, as shown in FIG. 1, between the impact sensor 6 and the electronic switch 5, a threshold or comparator stage 8 is additionally provided. This threshold stage permits only those output signals of the impact sensor 6, whose amplitude exceeds a certain threshold value, to be transmitted to the switch 5.

As mentioned above, the evaluation circuit 4 may recognize any of a number of given release criteria for an impact detonation. That is, the release criteria may be, for example, the recognition of a target, or the distance from a detected target as determined in any of a number of different ways.

Under conditions of military action, a combined proximity and impact fuze often must have an autonomous impact function in the detonator. For this purpose, the embodiment of the invention shown in FIG. 2, wherein like reference numerals are used to identify the same apparatus as described above with respect to FIG. 1, can be used to particular advantage. This embodiment represents a combination of the fuze according to the present invention with that disclosed in applicant's concurrently-filed U.S. Patent Application Ser. No. 246,697 entitled "Circuit Arrangement for an Impact Fuze" which relates to a circuit arrangement for preventing actuation of detonation in an impact fuze for barrel weapon ammunition upon impact with a rain drop. According to this application, means are connected to the impact sensor which increases the detonation response sensitivity of the entire fuze either continuously or in stages in dependence on the flight velocity - which, in the type of ammunition involved, continuously decreases from the time of firing with increasing duration of flight - or which switches once, at the end of a given period of flight since firing, from a first-given low value of detonation response sensitivity, to a second-given higher value. This is essentially achieved in that a variable attenuator or attenuation member is disposed in the detonation signal channel for attenuating the signal emitted by the impact sensor in dependence on the desired detonation response sensitivity of the fuze. Preferably, this variable attenuator is a switchable attenuation member, e.g., a controllable voltage divider, whose divider ratio is controlled by a timer circuit in the manner of a clock beginning with the moment of firing.

Figure 2:
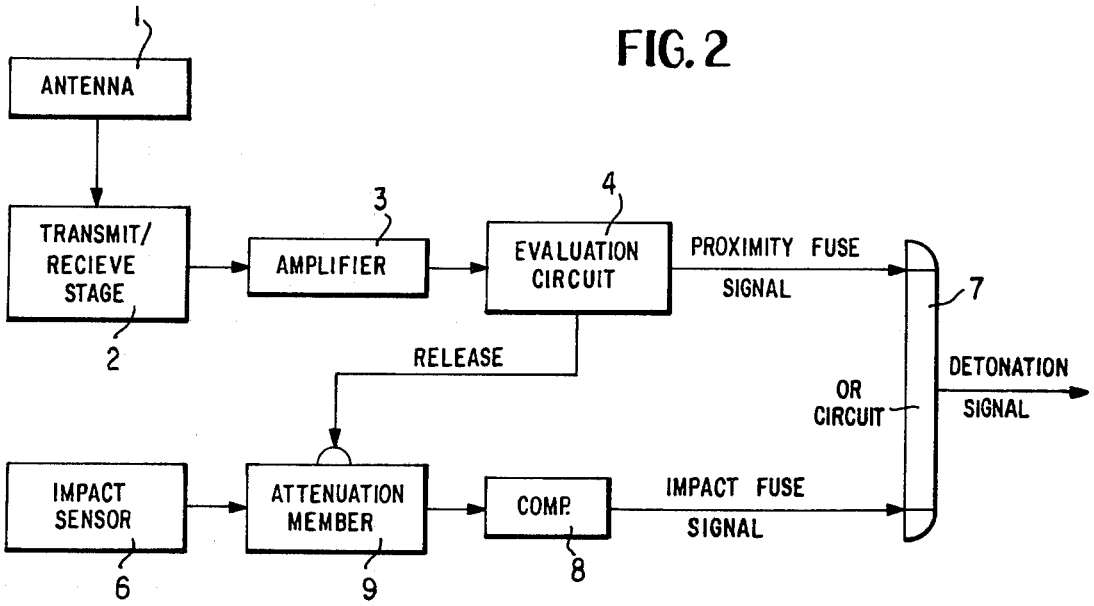
FIG. 2 is a block circuit diagram of another embodiment of an impact fuze according to the invention.

In the embodiment of the present invention according to FIG. 2, the above-mentioned attenuation member 9 is connected directly to the output of the impact sensor 6 and is switched, by the control output signal (release signal) of the evaluation circuit 4, in such a manner that, simultaneously with the release of the impact fuze, the response sensitivity of the impact fuze is increased. That is, the attenuation provided by the attenuation member 9 is decreased. As further indicated in this embodiment of the invention, the comparator or threshold circuit 8 is not connected to the output of the impact sensor 6, as in the embodiment of FIG. 1, but rather is connected between the output of the attenuation member 9 and the associated input of the OR circuit 7.

FIG. 3 shows in detail a block diagram of a preferred embodiment of an evaluation circuit 4 which, e.g., can advantageously be used in the embodiments of the invention according to FIGS. 1 and 2, respectively.

The output signal $f_D$ of the amplifier 3 is fed via a high pass filter 10 to a digital/analogue converter 11. The converter 11 delivers a voltage $u_{D1}$, the height of which is proportional to the frequency of the input signal of the converter.

The converter 11 is followed by a low pass filter 12. Two comparators 13 and 14 are fed by the output signal of the low pass filter 12. The outputs of the comparators 13 and 14 are connected with the inputs of an AND-circuit 15.

FIG. 4 is a diagram and shows the dependence of the Doppler frequency $f_D$ (corresponding to the voltage $u_{D1}$ mentioned above) upon the time t during which the fuze approaches and passes its target.

During the time interval between $t_0$ and $t_1$ only a clutter signal from the ground is received. A frequency level $f_1$ is generally not exceeded by the frequency $f_D$ during this time interval, with the exception of sporadic noise peaks.

The value of the time constant of the low pass filter 12 is chosen in such a way that both the proximity fuze signal and the release signal are generated only when a target is detected.

The Doppler frequency increases after the time $t_1$ to a maximum value and thereupon the Doppler frequency decreases to a minimum value when the fuze reaches the nearest distance to the target at the time $t_2$.

The output voltage $u_{D2}$ of the low pass filter 12 increases after the time $t_1$ and exceeds a threshold value $u_1$ which cannot be reached during the time before $t_1$. The comparator 13 comprises a Schmitt-trigger in order to achieve a hysteresis effect so that the comparator 13 delivers a signal until $u_{D2}$ becomes smaller than $u_3$.

The threshold value $u_2$ of the comparator 14 indicates the detonation point. The proximity detonation occurs when the comparators 13 and 14 deliver their output signal to the AND-gate 15 simultaneously.

$u_{Dimp}$ and $f_{Dimp}$ occur when an impact ignition is possible; in this case $u_{D2}$ cannot reach the proximity detonation point $u_2$.

In FIG. 3 the designations "5 or 9" and "RELEASE" refer to the possibility of connecting the circuit 4 with the electronic switch 5 and the attenuation member 9, respectively.

It will be understood that the above description of the present invention is susceptible to various modifications, changes and adaptions, and the same are intended to be comprehended within the meaning and range of equivalents of the appended claims.

I claim:

1. In a combined proximity and impact fuze employed in a missile, a circuit arrangement for avoiding the actuation of a detonation upon impingement of the impact fuze on a rain drop comprising means connected to said proximity fuze and responsive to the signals produced by the same for preventing the generation of a detonation signal upon impact until recognition by said proximity fuze that a given release criterion for impact detonation has been met.

2. A combined proximity and impact fuze as defined in claim 1 wherein said release criterion is the detection of the target by said proximity fuze.

3. A combined proximity and impact fuze as defined in claim 1 or 2 wherein said release criterion is the approach to a target at a given target distance as determined by said proximity fuze.

4. A combined proximity and impact fuze as defined in claim 1 wherein said release criterion is the attainment of a given received signal amplitude in said proximity fuze for a signal corresponding to a detected target.

5. A combined proximity and impact fuze as defined in claim 1 or 2 wherein said release criterion is the determination that the measured value for the relative radial velocity of the proximity fuze with respect to a detected target, as momentarily measured by said proximity fuze, remains constant within a given tolerance either for a given time interval beginning with detection of the target or within a given target distance range.

6. A combined proximity and impact fuze as defined in claims 1, 2 or 4 wherein said means includes an evaluation circuit means disposed in said proximity fuze for evaluating the received proximity signals and for determining when said given release condition for detonation has been met and for producing an output control signal at a control output, and means connected to said control output of said evaluation circuit means and responsive to said output control signal for preventing all impact detonation signals produced by the impact sensor of said impact fuze from being transmitted to the detonation signal channel of said combined fuze until receipt of said control signal.

7. A combined proximity and impact fuze as defined in claim 6 wherein said evaluation circuit means likewise evaluates the received proximity signals to produce a proximity fuze signal at a signal output; said means connected to said control output in an electronic switching circuit connected in series with the output of said impact sensor; and an OR circuit having its two inputs connected, respectively, to the signal output of said evaluation circuit means and to the output of said electronic switch.

8. A combined proximity and impact fuze as defined in claim 7 wherein said electronic switching circuit includes a variable attenuator circuit having its control input connected to said control output and a voltage threshold circuit connected in series between the output of said attenuator circuit and the associated said input of said OR circuit.

* * * * *